US005501619A

United States Patent [19]

Sakatani et al.

[11] Patent Number: 5,501,619

[45] Date of Patent: Mar. 26, 1996

[54] CONNECTOR

[75] Inventors: Atsushi Sakatani; Osamu Sasai; Masaji Suzuki, all of Yokkaichi, Japan

[73] Assignee: Sumitomo Wiring Systems, Ltd., Japan

[21] Appl. No.: 230,822

[22] Filed: Apr. 21, 1994

[30] Foreign Application Priority Data

May 7, 1993 [JP] Japan ..... 5-029267 U

[51] Int. Cl.[6] ..... H01R 13/514

[52] U.S. Cl. ..... 439/752; 439/596

[58] Field of Search ..... 439/596, 752

[56] References Cited

U.S. PATENT DOCUMENTS 5,147,222 9/1992 Hotea et al. ..... 439/752 X

FOREIGN PATENT DOCUMENTS 0477610 4/1992 European Pat. Off. .
3736036 2/1989 Germany .
61-232582 10/1986 Japan .
4-33663 8/1992 Japan .

*Primary Examiner*—Larry I. Schwartz

*Assistant Examiner*—Jill Demello

*Attorney, Agent, or Firm*—Oliff & Berridge

[57] ABSTRACT

A connector includes flexible hinge pieces molded of a synthetic resin, wherein each flexible hinge piece is caused to upwardly extend. When each side plate of a retainer is squeezed from above toward the rear end side of a recessed part formed on one side surface of a connector housing, a provisional engagement locking protuberance is fitted into the fore end side of an elongated hole, causing the fore edge of the side plate to be held between the provisional engagement locking protuberance and a normal engagement locking protuberance in the clamped state. The retainer is thus held in the provisionally engaged state. The hinge piece is folded in the connector housing, and the retainer positioned where each terminal piece can be inserted into and drawn from the corresponding terminal insert hole. When the retainer is further squeezed from above after the terminal piece is inserted into the terminal insert hole, a normal engagement locking protuberance is fitted into the fore end side of the elongated hole, causing the provisional engagement locking protuberance and the normal engagement locking protuberance to be engaged with the opposite ends of the elongated hole. The retainer is thus held in the normally engaged state.

12 Claims, 4 Drawing Sheets

CONNECTOR

BACKGROUND OF THE INVENTION

The present invention relates to a connector, and more particularly to a connector of the type including a plurality of retainers to exhibit a function of double engagement with the retainers.

A hitherto known connector of the type including a plurality of retainers so as to exhibit a function of double engagement with a connector housing is constructed such that a plurality of terminal inserting holes are formed in the connector housing so as to enable a plurality of terminal pieces to be inserted into the terminal inserting holes. The retainers are elastically connected to the connector housing via a plurality of flexible hinges. Primary engagement is established while the terminal pieces are inserted into the terminal insert holes with the aid of a plurality of elastic engagement pieces, with a possibility that the terminal pieces are disconnected from the connector housing. Secondary engagement is established by bringing a part of each retainer in the corresponding terminal inserting hole while the hinge pieces are folded and the retainers are firmly engaged with the connector housing.

The conventional connector constructed in the above-described manner is called a hinge type. In contrast with other types of conventional connectors including a plurality of retainers independently of a connector housing, the hinge type connector has an advantage that storage of connectors can easily be controlled because each connector only includes one component.

However, since each hinge piece is exposed to the outside while extending outside of the connector housing before the retainers are brought in engagement with the connector housing, e.g., in the case that an assembling operation is performed while primary engagement is established by inserting the terminal pieces into the terminal inserting holes formed in the connector housing, each hinge piece may come in contact with other articles during transportation of connectors or during each practical connecting operation. Due to a low strength of each hinge piece itself, there sometimes arises a problem that the hinge piece is broken or cut in pieces.

When an operation for inserting a plurality of terminal pieces into the connector housing is automatic, since each hinge piece is kept unstable while extending outside of the connector housing as mentioned above, it is difficult to hold terminal pieces during transportation of the latter conducted with the aid of a part feeder or a similar unit during each inserting operation. Thus, another problem is that it is not easy to cope with the foregoing difficulty.

SUMMARY OF THE INVENTION

The present invention has been made in consideration of the aforementioned problems, and an object of the invention resides in providing a connector that prevents each hinge piece from being broken or cut in pieces and enables a transporting operation to be achieved for connectors and the like with the aid of a part feeder or a similar unit.

To accomplish the above object, the present invention provides a connector including a connector housing having a plurality of terminal inserting holes formed therein so as to enable a plurality of terminal pieces to be inserted into the terminal inserting holes, wherein each retainer is elastically connected to the connector housing via a flexible hinge piece. Primary engagement is established while the terminal pieces are inserted into the terminal insert holes with a plurality of elastic engagement pieces engageable with the terminal pieces, with a possibility that the terminal pieces are disengaged from the connector housing. Secondary engagement is established by bringing a part of each retainer in the corresponding terminal insert hole while the retainer is firmly engaged with the connector housing as the hinge piece is folded. The connector includes a holding device for holding the retainers on the connector housing in the provisionally engaged state without preventing the terminal pieces from being inserted into the terminal insert holes, directly before the terminal pieces are held in the normally engaged state to establish the secondary engagement with the connector housing.

When each retainer is engaged with the connector housing as the hinge piece is folded, the terminal pieces are firmly held on the connector housing in the provisionally engaged state with the aid of the holding device, directly before they are held in the normally engaged state.

Since insertion of the terminal pieces into the terminal insert holes is not obstructed while the retainer is held in the provisionally engaged state, the terminal pieces can be inserted into the terminal insert hole to establish primary engagement with the connector housing after the retainers are held in the provisionally engaged state, and subsequently, the operative state of the retainer can be shifted to the normally engaged state, causing the terminal pieces to be brought in secondary engagement with the connector housing.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

Figure 1:
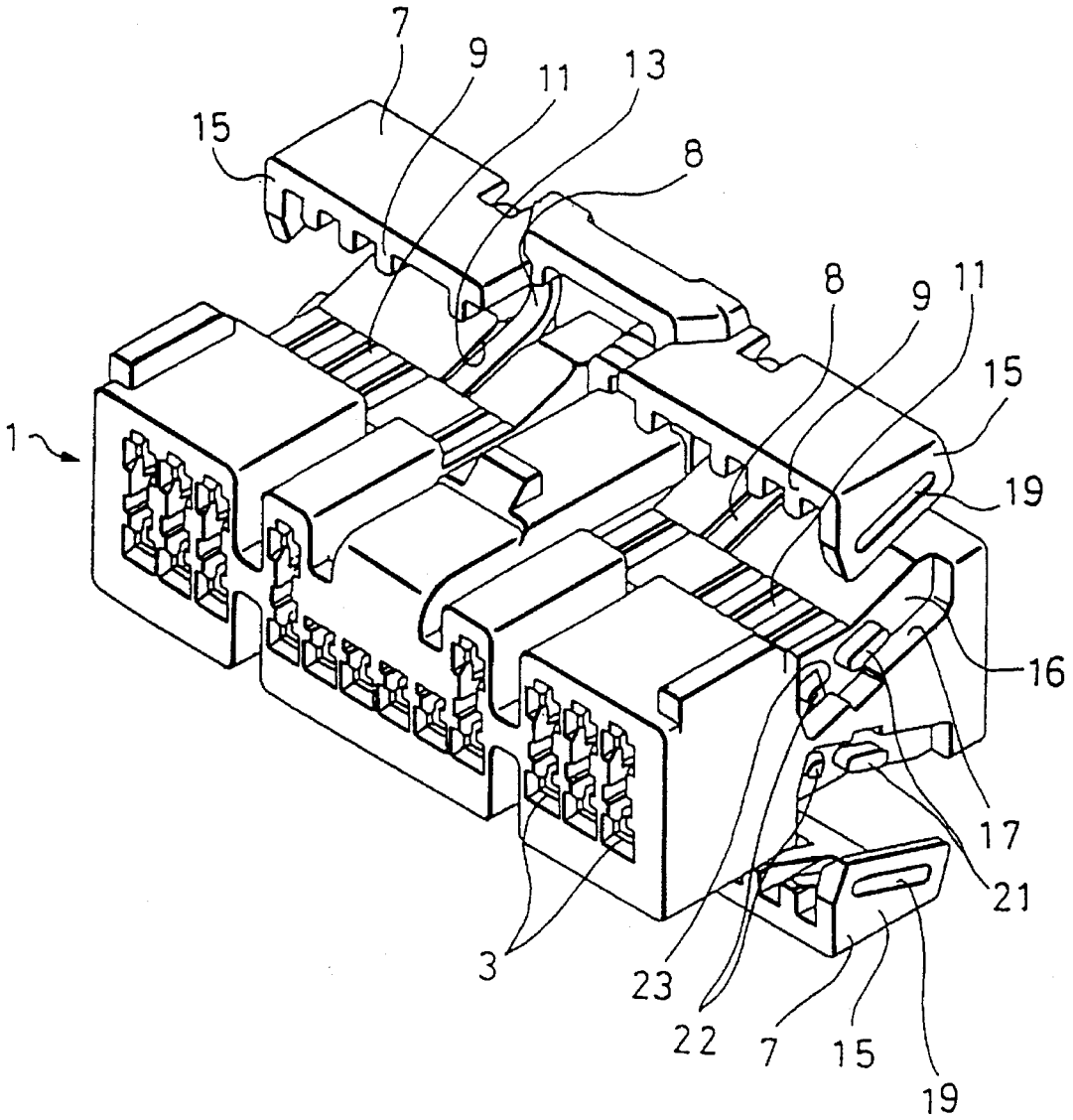
FIG. 1 is a perspective view of a connector constructed according to an embodiment of the present invention.

The present invention will now be described in detail hereinafter with reference to FIG. 1 to FIG. 4, which show a connector constructed according to an embodiment of the present invention.

In the drawings, reference numeral 1 designates a connector housing on the female side. A plurality of terminal inserting holes 3 each serving to enable a terminal piece 2 to be inserted from the rear surface side are stepwise formed in side-by-side relationship to build two stages, i.e., an upper stage and a lower stage for arranging the terminal inserting holes 3, and an elastic engagement piece 5 is formed on each vertically extending partition wall between adjacent terminal inserting holes 3 at both the upper and lower stages for preventing each terminal piece 2 from being disconnected from the connector housing 1.

To assure that secondary engagement is established with the connector housing 1 for preventing each terminal piece 2 from being disconnected from the connector housing 1, retainers 7 are formed integral with the connector housing 1 via two flexible hinge pieces 8 on both the upper and lower sides. When the connector 1 is formed of a synthetic resin, the hinge pieces 8 are caused to extend from the connector housing 1, causing the retainers 7 to be parted away from both the upper and lower surfaces of the connector housing 1.

A plurality of engagement pieces 9 each extending toward the front edge of each retainer 7 while gradually increasing a width thereof as measured in the vertical direction are formed on the retainer 7 in an equally spaced relationship as seen in the transverse direction with a predetermined distance between adjacent engagement pieces 9 corresponding to the terminal insert holes 3. A plurality of elongated insert slits 11 each having a rearward extending inclined surface 12 formed on the rear edge side are kept open on both the upper and lower surfaces of the terminal insert holes 3 arranged at both the upper and lower stages.

In addition, receiving slits 13 each capable of receiving a hinge piece 8 in the folded state therein are formed on both the upper and lower surfaces of the housing 1 at the positions corresponding to the hinge pieces 8 of the retainer 7.

Side plates 15 each extending toward the front edge of the retainer 7 while gradually increasing a width thereof as measured in the vertical direction are formed on the opposite side ends of the retainer 7. To cooperate with the side plates 15, recessed parts 16 each capable of receiving the side plate 15 therein with a width larger than that of the side plate 15 are formed on the opposite side walls of the connector housing 1. The bottom surface of each recessed part 16 is inclined corresponding to the inclination of the side plate 15 to serve as a guide surface 17.

As shown in detail on an enlarged scale in FIG. 2, an elongated hole 19 having a predetermined length is formed through each side plate 15 of the retainer 7 while extending in parallel with the bottom surface of the side plate 15. A provisional engagement locking protuberance 21 adapted to be fitted into the elongated hole 19 and having a length shorter than that of the elongated hole 19 is disposed on the side wall of the recessed part 16. In addition, a normal engagement locking protuberance 22 likewise adapted to be fitted into the elongated hole 19 is disposed at a position located ahead of the provisional engagement locking protuberance 21. The elongated hole 19, the provisional engagement locking protuberance 21 and the normal engagement locking protuberance 22 are arranged in parallel with the guide surface 17 of the recessed part 16 with a predetermined distance held therebetween and are linearly aligned. The distance between the foremost end of the normal engagement locking protuberance 22 and the rearmost end of the provisional engagement locking protuberance 21 is substantially equal to the length of the elongated hole 19. An inclined surface 23 is formed on a part of the normal engagement locking protuberance 22 and located opposite to the foremost end of the provisional engagement locking protuberance 21.

Next, a mode of operation of the connector constructed in the aforementioned manner will be described below. Since the connector is designed in a symmetrical relationship as seen in the axial direction of cables, i.e., an upper half of the connector is identical with a lower half of the same, only the upper half of the connector 1 will be described below for the purpose of simplification.

Figure 2A:
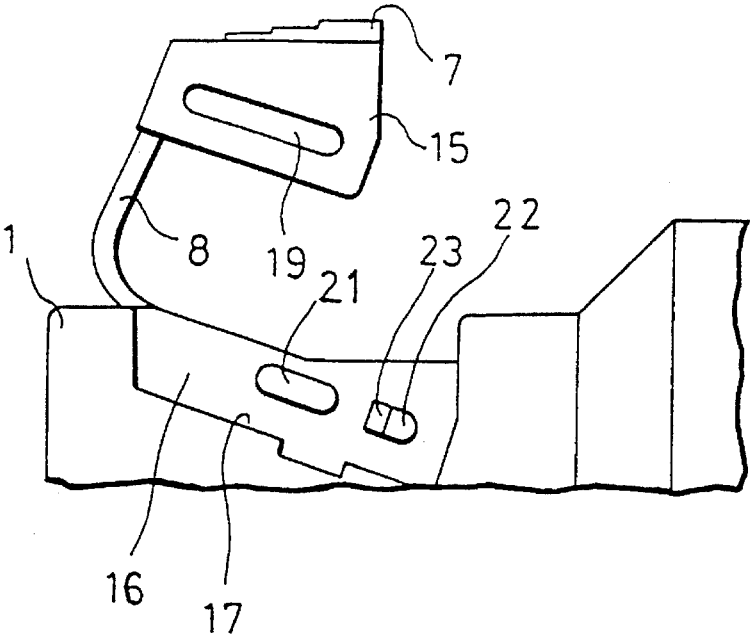
FIGS. 2(A), 2(B) and 2(C) are fragmentary enlarged front views of a retainer of the invention.

As shown in FIG. 2(A), the connector housing 1 is molded of a synthetic resin such that the hinge piece 8 is caused to extend in the upward direction allowing the retainer 7 to be upwardly parted away from the connector housing 1 via the hinge piece 8.

Figure 2B:
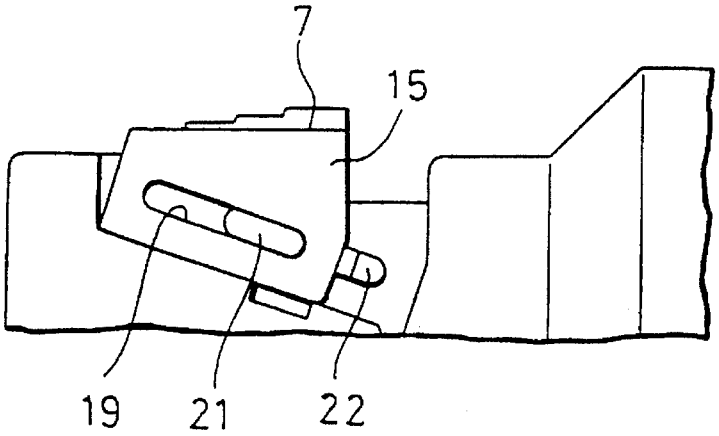

When the side plate 15 of the retainer 7 is squeezed from above toward the rear end side of the recessed part 16 while the foregoing state is maintained, the lower surface of the side plate 15 collides against the provisional engagement locking protuberance 21, and subsequently, the side plate 15 is expanded in a sideward direction due to elastic deformation thereof, causing it to climb on the provisional engagement locking protuberance 21. When the elongated hole 19 of the side plate 15 is located in alignment with the provisional engagement locking protuberance 21, the side plate 15 is elastically contracted to assume the original state so that the provisional engagement locking protuberance 21 is fitted into the fore end side of the elongated hole 19 as shown in FIG. 2(B). At this time, since the fore edge of the side plate 15 is held between the provisional engagement locking protuberance 21 and the normal engagement locking protuberance 22 in the clamped state, both the side plates 15 (i.e., the retainer 7) are prevented from being turnably displaced.

Figure 3A:
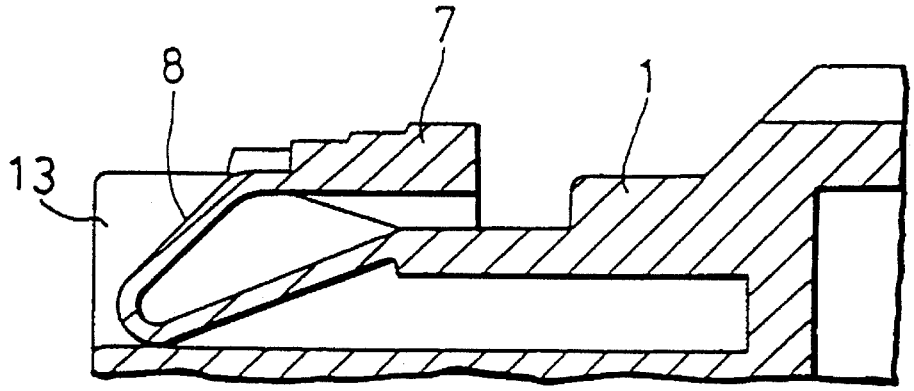
FIGS. 3(A) and 3(B) show by way of fragmentary enlarged sectional views the state that a hinge piece is received in a hinge piece receiving slit.
Figure 4A:
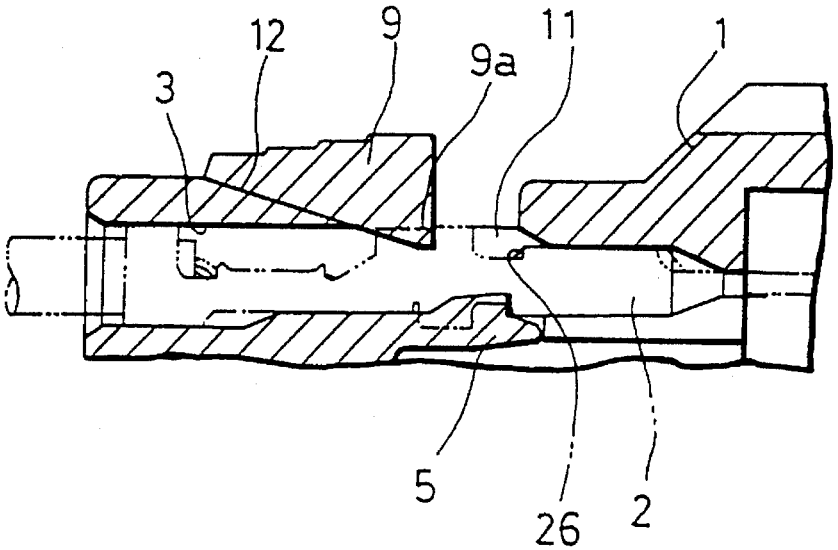
FIGS. 4(A) and 4(B) show by way of fragmentary enlarged sectional views how a secondary engaging operation is performed for a terminal piece.

This represents the operative state of the connector, wherein the retainer 7 is held in the provisionally engaged state. At this time, as shown in FIG. 3(A), the hinge piece 8 is folded and received in the receiving slit 13 formed in the connector housing 1, and as shown in FIG. 4(A), the engagement pieces 9 of the retainer 7 are located in a waiting state at positions where inserting and drawing of each terminal piece 2 are not obstructed by projected parts **9*a* of the engagement pieces 9 at their foremost ends. When the terminal piece 2 is inserted into the terminal insert hole 3 of the connector housing 1 while elastically deforming the elastic engagement piece 5, the elastic engagement piece 5 is restored to the original position where it is inserted into the terminal insert hole 3 to reach the deepest position. At this time, the elastic engagement piece 5 is received into a fitting recess 25 formed on the bottom surface of the terminal piece 2, causing the terminal piece 2 to be brought in primary engagement with the connector housing 1, securely preventing disconnection from the connector housing 1**.

Since the retainer 7 is held in the provisionally engaged state relative to the connector housing 1 while the hinge piece 8 is received in the receiving slot 13 in the folded state both when the connector housing 1 is kept inoperative before each terminal piece 2 is inserted into the corresponding terminal insert hole 3 and when the connector housing 1 is held in the assembled state while the terminal piece 2 is inserted into the terminal insert hole 3, the hinge piece 8 is prevented from being broken or cut in pieces due to collision or contact with other articles during transportation of connectors and the like or during each practical connecting operation.

Figure 2C:
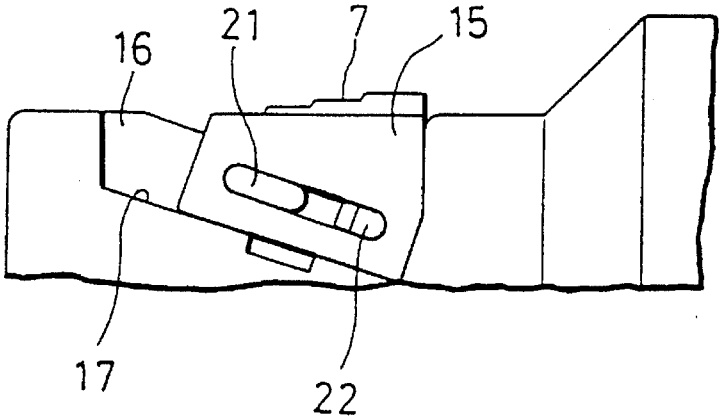

When the retainer 7 is squeezed from above further from the provisionally engaged state, the bottom surface of the side plates 15 are slantwise downwardly displaced in the forward direction along the guide surface 17 of the recessed part 16, causing the fore end part of the side plate 15 to climb on the normal engagement locking protuberance 22 via the inclined surface 23. Thereafter, the normal engagement locking protuberance 22 is fitted into the fore end part of the elongated hole 19 as shown in FIG. 2(C). Consequently, the opposite ends of the elongated hole 19 are engaged with the rear ends of the normal engagement locking protuberance 22 and the provisional engagement locking protuberance 21, respectively, resulting in the connector housing 1 being held in the normally engaged state.

Figure 3B:
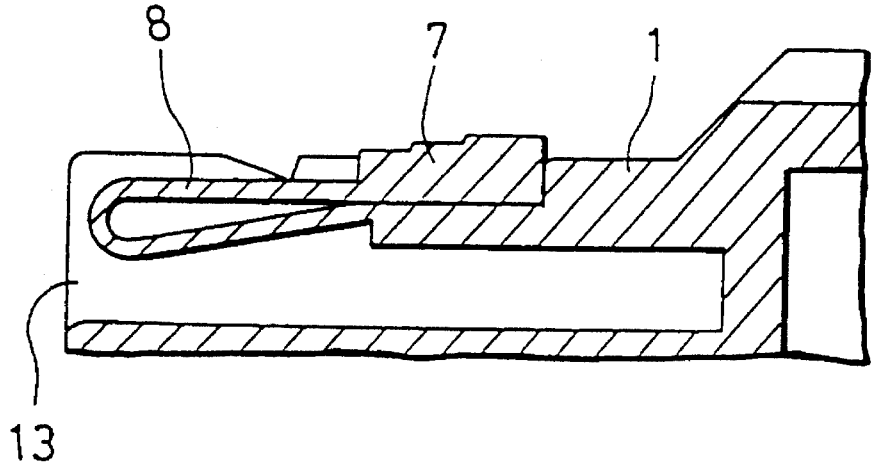
Figure 4B:
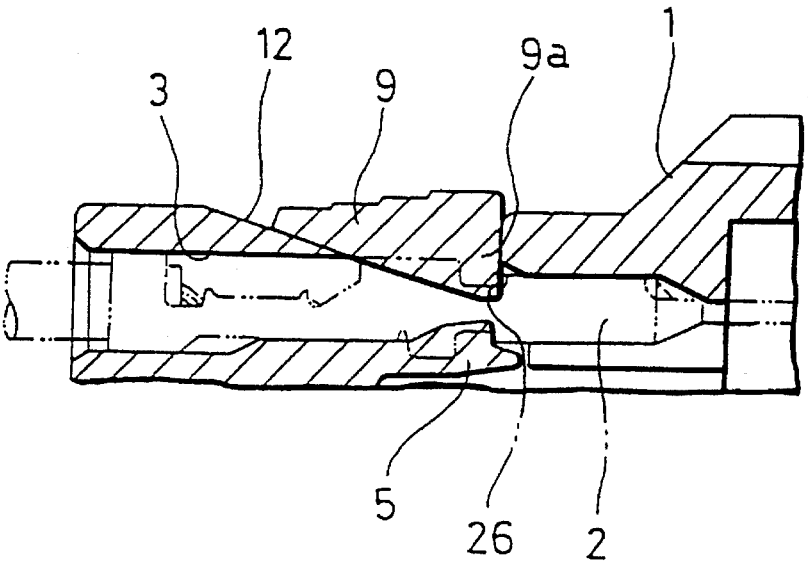

As shown in FIG. 3(B), the hinge piece 8 is additionally folded as it is received in the receiving slot 13, and moreover, as shown in FIG. 4(B), the engagement piece 9 of the retainer 7 is slantwise downwardly displaced in the forward direction along the guide surface 12 of the retainer receiving slit 11 until the projected portion 9*a* of the engagement piece 9 at the foremost end of the engagement piece 9 is brought in the terminal insert hole 3 in engagement with the front edge of a box-like portion 26 formed on the upper surface of the terminal piece 2. Thus, secondary engagement is established with the connector.

Since each retainer can be held on the connector housing in the provisionally engaged state while the hinge piece is folded, the hinge piece can be prevented from being broken or cut in pieces due to collision or contact with other articles during transportation or during each connecting operation both when the connector housing is kept inoperative and when the connector housing is held in the assembled state while the terminal pieces are inserted into the terminal insert holes.

In addition, when the terminal pieces are automatically inserted into the connector housing, the connector housing can stably be held by holding the retainer in the provisionally engaged state. Thus, automatic transportation of connector housings to an inserting operation location as well as automatic holding of the connector housings at the inserting operation location can accurately and easily be conducted.

While the embodiments disclosed herein are preferred, it will be appreciated from this teaching that various alternatives, modifications, variations or improvements therein may be made by those skilled in the art that are within the scope of the invention, which is defined by the following claims. For example, while the present invention has been made above with respect to a connector on the female side, it should of course be understood that the present invention should not be limited only to this but it may equally be applied to a connector on the male side while exhibiting the same advantageous effects as mentioned above.

What is claimed is:

1. A connector having a plurality of terminal insert holes for receiving a plurality of terminal pieces, the connector comprising:

a retainer having a first portion fixed to said connector via at least one flexible member and a second portion engageable with said connector between a provisionally engaged position and a normally engaged position; and a recessed portion for receiving said second portion of said retainer, said recessed portion comprising an attachment mechanism for attaching said retainer to said connector in said provisionally engaged position and said normally engaged position such that said plurality of terminal pieces are insertable into said plurality of terminal insert holes in said provisionally engaged position, wherein said attachment mechanism comprises a provisional engagement locking protuberance disposed in said recessed portion; and a normal engagement locking protuberance disposed in said recessed portion and aligned with said provisional engagement locking protuberance, wherein said second portion comprises an elongated slot shaped to receive said provisional engagement locking protuberance in said provisionally engaged position and to receive said normal engagement locking protuberance and said provisional engagement locking protuberance in said normally engaged position.

2. A connector according to claim 1, wherein opposite ends of said normal engagement locking protuberance and said provisional engagement locking protuberance are spaced a distance corresponding to a width of said elongated slot.

3. A connector according to claim 1, wherein said attachment mechanism further comprises a guide surface in said recessed portion, said guide surface guiding said retainer between said provisionally engaged position and said normally engaged position.

4. A connector according to claim 3, wherein said normal engagement locking protuberance comprises an inclined surface on a side facing said provisional engagement locking protuberance, said inclined surface facilitating a shift between said provisionally engaged position and said normally engaged position.

5. A connector having a plurality of terminal insert holes for receiving a plurality of terminal pieces, the connector comprising:

a retainer having a first portion fixed to said connector via at least one flexible member and a second portion engageable with said connector between a provisionally engaged position and a normally engaged position;

a recessed portion for receiving said second portion of said retainer, said recessed portion comprising means for attaching said retainer to said connector in said provisionally engaged position and said normally engaged position such that said plurality of terminal pieces are insertable into said plurality of terminal insert holes in said provisionally engaged position; and an inclined guide surface in said recessed portion, said guide surface guiding said retainer between said provisionally engaged position and said normally engaged position.

6. A connector according to claim 5, comprising at least two recessed portions, wherein said retainer comprises a corresponding at least two second portions.

7. A connector according to claim 5, further comprising at least one receiving slit shaped to receive said flexible member in a folded state in said provisionally engaged position and said normally engaged position.

8. A connector according to claim 5, wherein said attachment means comprises:

a provisional engagement locking protuberance disposed in said recessed portion; and a normal engagement locking protuberance disposed in said recessed portion and aligned with said provisional engagement locking protuberance, wherein said second portion comprises an elongated slot shaped to receive said provisional engagement locking protuberance in said provisionally engaged position and to receive said normal engagement locking protuberance and said provisional engagement locking protuberance in said normally engaged position.

9. A connector according to claim 8, wherein said normal engagement locking protuberance comprises an inclined surface on a side facing said provisional engagement locking protuberance, said inclined surface facilitating a shift between said provisionally engaged position and said normally engaged position.

10. A connector according to claim 8, wherein opposite ends of said normal engagement locking protuberance and said provisional engagement locking protuberance are spaced a distance corresponding to a width of said elongated slot.

11. A connector having a plurality of terminal insert holes for receiving a plurality of terminal pieces, the connector comprising:

a retainer having a first portion fixed to said connector via at least one flexible member and at least two second portions engageable with said connector between a provisionally engaged position and a normally engaged position; and at least two recessed portions for receiving said at least two second portions of said retainer, said at least two recessed portions comprising an attachment mechanism for attaching said retainer to said connector in said provisionally engaged position and said normally engaged position such that said plurality of terminal pieces are insertable into said plurality of terminal insert holes in said provisionally engaged position.

12. A connector having a plurality of terminal insert holes for receiving a plurality of terminal pieces, the connector comprising:

a retainer having a first portion fixed to said connector via at least one flexible member and a second portion engageable with said connector between a provisionally engaged position and a normally engaged position;

a recessed portion for receiving said second portion of said retainer, said recessed portion comprising an attachment mechanism for attaching said retainer to said connector in said provisionally engaged position and said normally engaged position such that said plurality of terminal pieces are insertable into said plurality of terminal insert holes in said provisionally engaged position; and at least one receiving slit shaped to receive said flexible member in a folded state in said provisionally engaged position and said normally engaged position.

* * * * *